US010688377B1

(12) United States Patent
Fugel

(10) Patent No.: US 10,688,377 B1
(45) Date of Patent: Jun. 23, 2020

(54) SYSTEMS FOR MOUNTING ACCESSORIES ON SKATEBOARDS

(71) Applicant: Tedy Fugel, Los Angeles, CA (US)

(72) Inventor: Tedy Fugel, Los Angeles, CA (US)

(73) Assignee: Tedy Fugel, Los Angeles, CA (US)

( * ) Notice: Subject to any disclaimer, the term of this patent is extended or adjusted under 35 U.S.C. 154(b) by 0 days.

(21) Appl. No.: 16/595,400

(22) Filed: Oct. 7, 2019

(51) Int. Cl.
*A63C 17/00* (2006.01)
*A63C 17/26* (2006.01)
*A63C 17/01* (2006.01)

(52) U.S. Cl.
CPC ..... *A63C 17/26* (2013.01); *A63C 17/012* (2013.01); *A63C 2203/14* (2013.01)

(58) Field of Classification Search
CPC ..... A63C 17/26; A63C 17/01; A63C 17/12; A63C 5/02
See application file for complete search history.

(56) References Cited

U.S. PATENT DOCUMENTS 3,636,894 A * 1/1972 Hage ..... A47B 3/06 108/156
7,748,768 B2 * 7/2010 Hofacker ..... E05D 5/121 16/374
9,290,143 B2 * 3/2016 Arjona ..... B60R 19/54
9,551,176 B2 * 1/2017 Sasa ..... E05D 3/02
9,604,125 B2 3/2017 Page
9,878,230 B1 * 1/2018 Seele ..... A63C 17/26
10,022,616 B1 7/2018 Consol
2003/0201620 A1 * 10/2003 Seelye ..... A63C 17/01 280/87.042
2005/0030746 A1 * 2/2005 Goode ..... A63C 17/26 362/253
2008/0036165 A1 * 2/2008 Reinson ..... A63C 17/01 280/87.042
2012/0092886 A1 * 4/2012 Calhoun ..... A63C 17/26 362/549
2012/0227215 A1 * 9/2012 Katou ..... E05D 5/062 16/273
2014/0210187 A1 * 7/2014 Ritter ..... A63C 5/02 280/611
2017/0056756 A1 * 3/2017 Pikulski ..... A63C 17/12
2017/0326434 A1 11/2017 Faeth
2018/0196205 A1 * 7/2018 Song ..... G02B 6/42

* cited by examiner

*Primary Examiner* — Hau V Phan
(74) *Attorney, Agent, or Firm* — Camuti Law Group, APC; Nathan Camuti

(57) ABSTRACT

There is provided a system for mounting accessories on skateboards including a mounting baseplate having at least two mounting holes, a receiving port formed by a first support and a second support, wherein the second support includes a retention element, the supports extending from the second side of the mounting baseplate, the receiving port angled at a mounting angle, a securing element extending through the first support and the second support and engaging the retention element, and an accessory housing including an accessory body housing an accessory, and a mounting element extending from the accessory body, the accessory housing connected to the mounting baseplate by the mounting element engaged with the receiving port and secured in place by the securing element, and wherein the receiving port is oriented at the mounting angle to allow engagement of the accessory housing without interference from a truck mounting hardware.

9 Claims, 5 Drawing Sheets

SYSTEMS FOR MOUNTING ACCESSORIES ON SKATEBOARDS

BACKGROUND

Skateboarders take photographs and record videos of their tricks, stunts, and maneuvers. Occasionally, skateboarders engage in their activities in dim lighting or at night. When skating, skateboarders have to choose between holding the cameras, lights, and accessories in their hands as they skate or setting the cameras, lights, and accessories on stationary stands. However, carrying the accessories while skating results in blurry images, shaky video, and shaky and inconsistent lighting; stand-mounted accessories only provide stationary camera views and lighting. A system for mounting accessories on skateboards is needed.

SUMMARY

The present disclosure is directed to systems for mounting accessories on skateboards, substantially as shown in and/or described in connection with at least one of the figures, as set forth more completely in the claims.

In some implementations, the present disclosure includes a system for mounting accessories on skateboards including a mounting baseplate having a first side and a second side opposite the first side with at least two mounting holes in the mounting baseplate from the first side to the second side, the mounting holes being substantially perpendicular to the plane of the second side of the mounting baseplate and spaced apart from each other at a distance equal to the distance of truck mounting bolts for mounting a skateboard truck to a skateboard, a receiving port formed by a first support and a second support, wherein the second support includes a retention element, the supports extending from the second side of the mounting baseplate, the receiving port angled at a mounting angle, and a securing element extending through the first support and the second support and engaging the retention element.

In some implementations, the system for mounting accessories on skateboards further comprises an accessory housing including an accessory housing, and a mounting element extending from the accessory housing, the accessory housing connected to the mounting baseplate by the mounting element engaged with the receiving port and secured in place by the securing element, wherein the securing element extends through the first support of the receiving port, through the mounting element, and through the second support of the receiving port, and wherein the receiving port is oriented at the mounting angle to allow engagement of the accessory housing without interference from a truck mounting hardware.

In some implementations, the accessory is one of a camera and a light.

In some implementations, the accessory is a camera, wherein the camera is one of a still camera and a video camera.

In some implementations, the mounting angle is an acute angle between about thirty degrees and about eighty-nine degrees measured from the plane of the second side.

In some implementations, the mounting baseplate is formed in the baseplate of a skateboard truck.

In some implementations, The skateboard the mounting baseplate is a separate baseplate for installation on a skateboard on a lower side of a skateboard truck baseplate, wherein the lower side of the skateboard truck baseplate is opposite an upper side of the skateboard truck baseplate, the upper side of the skateboard truck baseplate being the side which is facing a skateboard deck when a complete skateboard is assembled.

In some implementations, the system mounted on one of a front truck of a skateboard and a rear truck of the skateboard.

In some implementations, the system for mounting accessories on skateboards is mounted on one of a left side of a skateboard and a right side of the skateboard.

DETAILED DESCRIPTION

Figure 1:
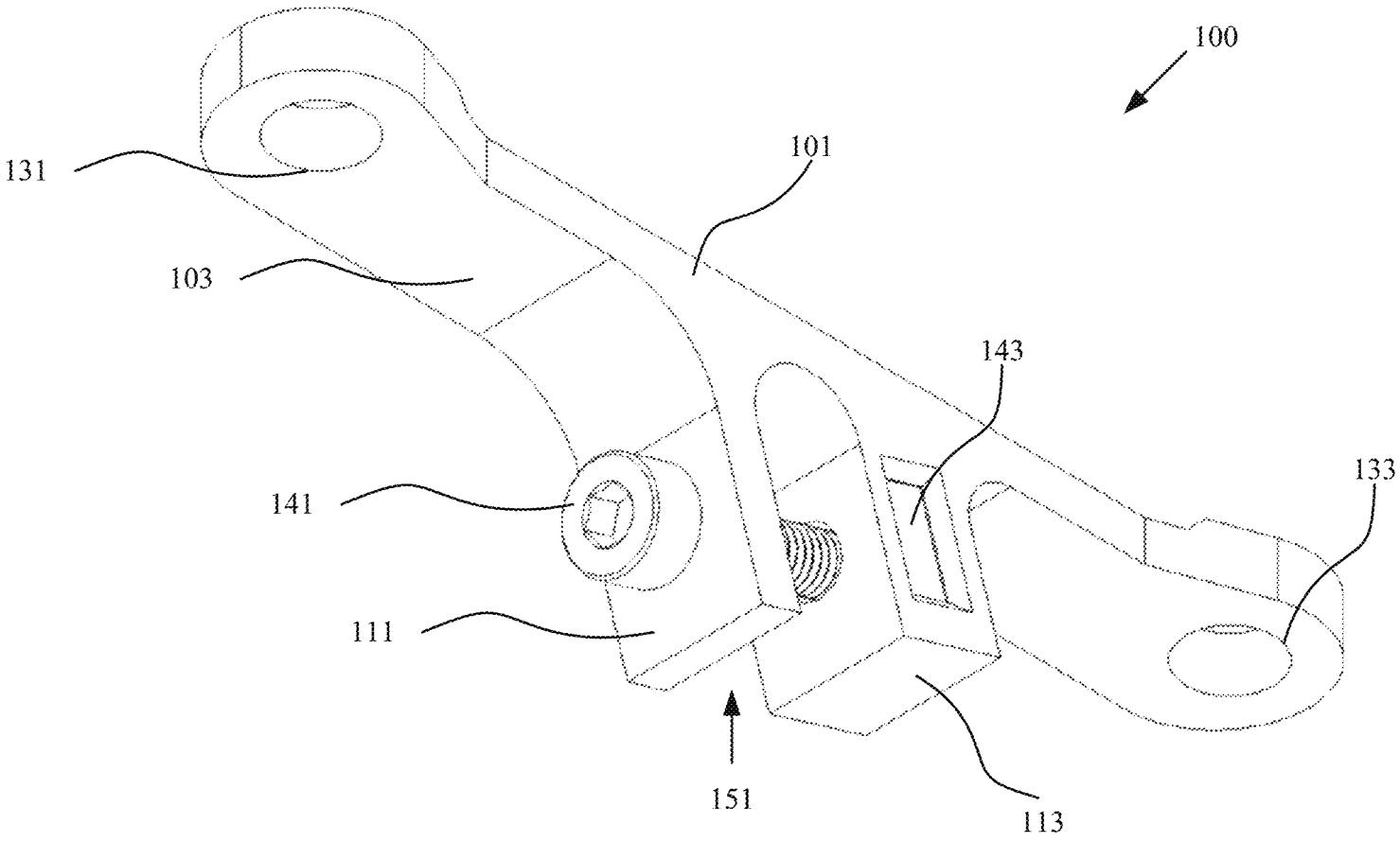
FIG. 1 shows a diagram of an exemplary system for mounting accessories on skateboards, according to one implementation of the present disclosure.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale and are not intended to correspond to actual relative dimensions.

A skateboard typically includes a plywood skateboard deck made from 7-ply or 9-ply plywood. The skateboard deck has a nose and a tail, where the nose is the end of the deck in the front (relative to direction of travel) during normal use of the skateboard. The tail is the end of the skateboard deck in the rear during normal use. From time to time, the skater may use the skateboard with the tail in the front and nose in rear. Some skateboard decks are unidirectional with a distinct tail and a distinct nose. Other skateboard decks are more bi-directional having a similar shape, profile, and orientation of the nose and tail.

A skateboard may have a longitudinal axis extending from the tail of the skateboard to a nose of the skateboard. Skateboards are typically substantially symmetrical across the longitudinal axis. The typical skateboard has two skateboard trucks mounted to a skateboard deck using truck mounting hardware. The truck mounting hardware for each of the two trucks may include four truck bolts each secured in place by truck mounting nut. The truck mounting nut may be a hex nut and may include a nylon lock ring.

In some implementations, the four truck-mounting bolts may secure each skateboard truck in place extending from a top side of a skateboard deck, through the skateboard deck, optionally through a skateboard riser, through a skateboard truck baseplate, and into the truck mounting nut. The truck mounting nut may be threaded into the truck mounting bolt and tightened so that the four truck mounting bolts, each threadably engaged with a mounting nut and tightened, secure the skateboard truck to the skateboard deck. The skateboard may have a front truck mounted on the front section of the skateboard and a rear truck mounted on the rear section of the skateboard, where the front section and rear section are determined by a transverse axis extending across the skateboard deck substantially perpendicular to the longitudinal axis and bisecting the skateboard deck between the nose and the tail.

FIG. 1 shows a diagram of an exemplary system for mounting accessories on skateboards, according to one implementation of the present disclosure. Mounting system 100 shows mounting baseplate 101 with support 111 and support 113 extending from mounting baseplate 101 and forming receiving port 151. Mounting baseplate 101 includes mounting hole 131 and mounting hole 133. Mounting hole 131 and mounting hole 133 may have a diameter substantially similar to the diameter of truck mounting holes in a skateboard. Mounting hole 131 and mounting hole 133 may be substantially perpendicular to the plane of surface 103 of mounting baseplate 101.

In some implementations, mounting hole 131 and mounting hole 133 may be spaced apart from one another at a distance for mounting on a skateboard using the standard skateboard truck mounting hole pattern. In one implementation, mounting hole 131 may be spaced apart from mounting hole 133 at a distance of about 2.125 inches, center to center. In another implementation, mounting hole 131 may be spaced apart from mounting hole 133 at a distance of about 2.5 inches, center to center.

In some implementations, mounting baseplate 101 may be a directional baseplate having a cut-away portion to accommodate certain skateboard trucks having protruding hanger support bases and kingpin support cups. As shown in FIG. 1, mounting baseplate 101 is a directional baseplate as can be seen by the width of mounting baseplate 101 at mounting hole 131 and mounting hole 133 being wider than the width of mounting baseplate 101 along the section extending between mounting hole 131 and mounting hole 133. In other implementations, the width of baseplate 101 may be constant. Mounting baseplate 101 may be formed from metal, plastic, carbon fiber composite, or other suitable materials. In some implementations, mounting baseplate 101 may be molded, injection molded, printed with a three-dimensional (3-D) printer, etc. In some implementations, mounting baseplate 101 may be the skateboard truck baseplate with support 111 and support 113 formed as a part of the skateboard truck baseplate.

As shown in FIG. 1, mounting system 100 includes securing element 141. Securing element 141 may extend through support 111, receiving port 151, and through support 113. In some implementations, securing element 141 may extend partially through support 113. In other implementations, securing element 141 may extend completely through support 113 or extend through and beyond support 113. Securing element 141 may be a screw, a machine bolt, a flat-head bolt, a hex bolt, or other threaded bolt. Securing element 141 may be partially threaded or fully threaded. In other implementations, securing element 141 may be a non-threaded pin, such as a cotter pin, hitch pin, etc. Securing element 141 may be made of metal, plastic, or other suitable material. Securing element 141 may be removable.

Retention element 143 may be an element for engaging securing element 141 and retaining securing element 141 in place. In some implementations, retention element 143 may be incorporated into support 113, such as by including a threaded port in support 113 for engaging and retaining securing element 141. In other implementations, retention element 143 may be a threaded nut, such as a hex nut, housed in a port in support 113. In some implementations, retention element 143 may be a hex nut placed in a port formed in support 113.

Figure 2:
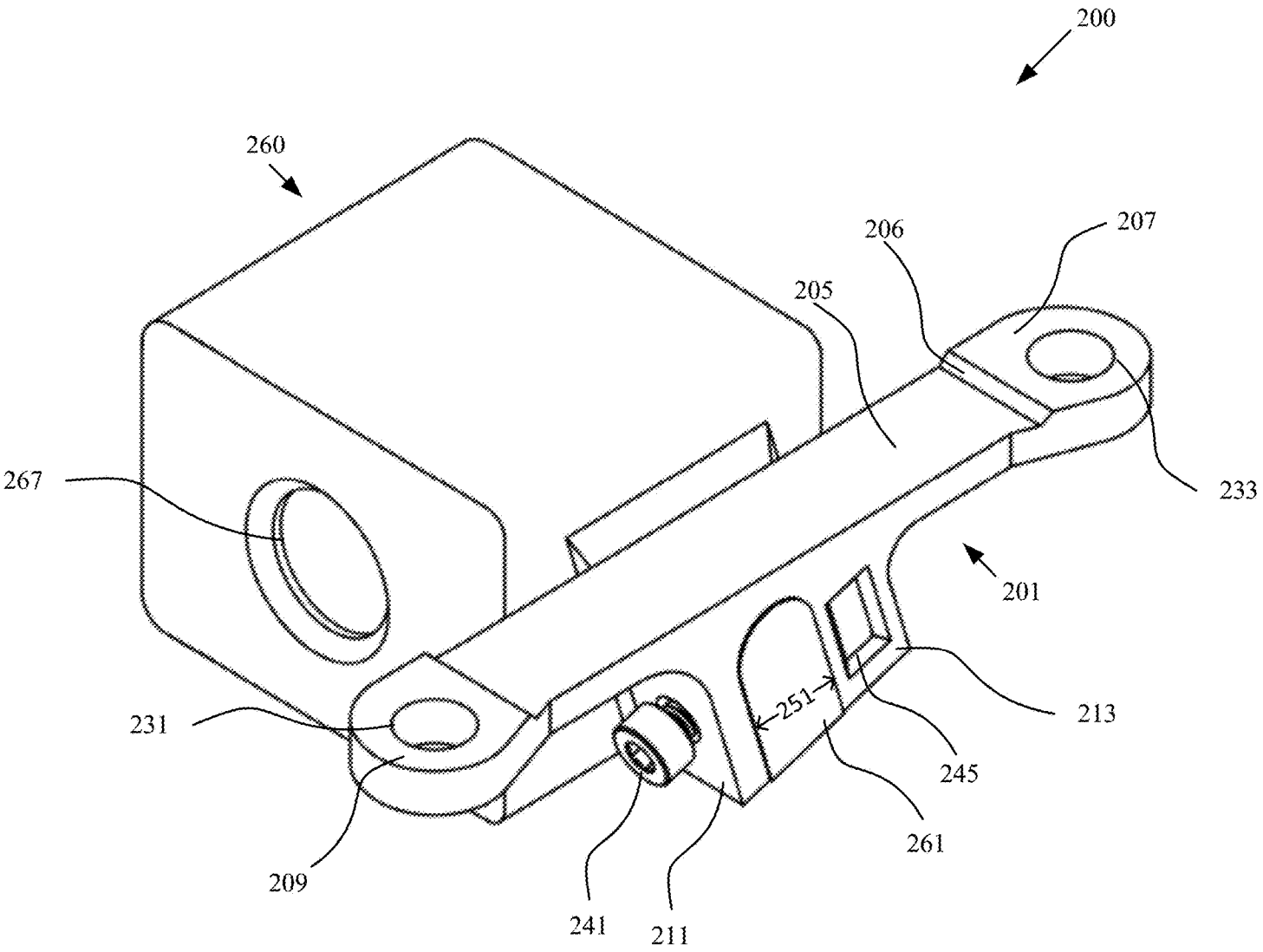
FIG. 2 shows a diagram of another exemplary system for mounting accessories on skateboards, according to one implementation of the present disclosure.

FIG. 2 shows a diagram of another exemplary system for mounting accessories on skateboards, according to one implementation of the present disclosure. Mounting system 200 shows mounting baseplate 201 including mounting hole 231, mounting hole 233, support 211, and support 213. Support 211 and support 213 form receiving port 251. As shown in FIG. 2, mounting system 200 includes surface 205, surface 207, and surface 209. Surface 205, surface 207, and surface 209 are surfaces that that face the deck of a skateboard when mounting baseplate 201 is mounted on the skateboard. As shown in FIG. 2, surface 207 and surface 209 are substantially co-planar and are extended beyond surface 205 by riser 206 making the plane of surfaces 207 and 209 nearer a skateboard deck when mounting baseplate 201 is mounted on the skateboard. In some implementations, riser 206 creates a clearance between mounting baseplate 201 and the truck baseplate when mounting baseplate 201 is mounted on a skateboard. As shown in FIG. 2, support 213 includes port 245. In some implementations, port 245 may house a retention element, such as a hex nut for securing and retaining a securing element 241.

As shown in FIG. 2, mounting system 200 includes accessory housing 260. Accessory housing 260 includes and mounting element 261 extending laterally from a side of accessory housing 260. In some implementations, accessory housing 260 may include accessory port 267. Accessory port 267 may be a port formed in accessory housing 260 to allow an accessory housed in accessory housing 260 access to the world outside of accessory housing 260. By way of non-limiting example, accessory port 267 may allow a light, such as a light emitting diode (LED), to shine light from inside accessory housing 260 out into the world to illuminate an area in front of or behind a skateboard to which mounting system 200 is mounted. In other implementations, accessory port 267 may allow a camera, such as a still-picture camera or a video camera, housed in accessory housing 260 to capture images of a scene in front of or behind a skateboard to which mounting system 200 is mounted.

Mounting system 200 shows mounting element 261 engaged in receiving port 251 between support 211 and support 213. Securing element 241 may connect mounting baseplate 201 with accessory housing 260 and secure accessory housing 260 in place. In some implementations, securing element 241 extends from outside support 211, through support 211, through mounting element 261, and through support 213. Securing element 241 may be retained by a retention element included in support 213, such as a threaded port formed in support 213, or a securing element housed in port 245.

Receiving port 251 may be a channel formed between support 211 and support 213. In some implementations, receiving port 251 may have a first end and a second end, wherein the first end is an open end and the second end is a closed end. Accessory housing 260 may engage receiving port 251 laterally or by sliding into receiving port 251 along the length of receiving port 251 between support 211 and support 213. In other implementations, the first end may be a closed end and the second end may be a closed end and accessory housing 260 may engage receiving port 251 laterally. As shown in FIG. 2, the first end is an open end and the second end is a closed end. The second end may be formed as a rounded end, such as a semicircular end, to help withstand and distribute stress, pressure, and vibration from the skateboard while in motion and to help prevent build-up of dirt, grease or their material that may interfere installation of accessory housing element 206.

Figure 3:
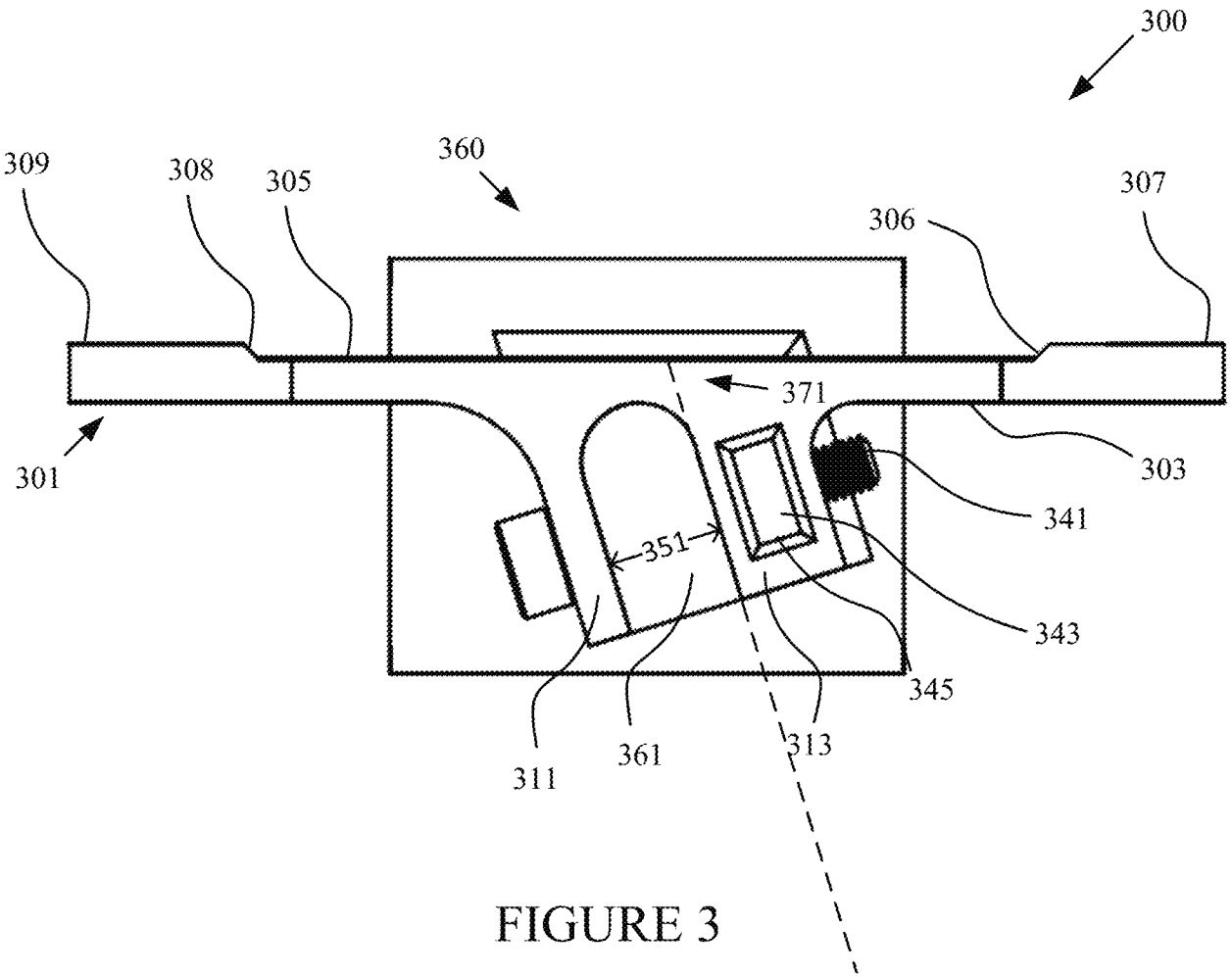
FIG. 3 shows another view of the system for mounting accessories on skateboards of FIG. 2, according to one implementation of the present disclosure.

FIG. 3 shows another view of the system for mounting accessories on skateboards of FIG. 2, according to one implementation of the present disclosure. Mounting system 300 includes mounting baseplate 301 connected to accessory housing 360. Mounting element 361 extends from a side of accessory housing 360 and engages mounting baseplate 301 via receiving port 351 defined by support 311 and support 313. Securing element 341 extends through support 311, mounting element 361, support 313, and retention element 343.

As shown in FIG. 3, mounting baseplate 301 includes surface 303 opposite surface 305, and co-planar surfaces surface 307 and surface 309, raised from surface 305 by riser 306 and riser 308, respectively. When mounting system 300 is mounted on a skateboard, surfaces 307 and 309 may contact the skateboard truck baseplate of a skateboard truck mounted on the skateboard. The clearance formed by riser 306 and riser 308 may allow installation of mounting baseplate 301 on the skateboard without interference from letters molded in the skateboard truck baseplate.

Accessory housing 360 may be securely connected to mounting baseplate 301 by mounting element 361 engaged in receiving port 351. In some implementations, receiving port 351 may be formed at mounting angle 371. Mounting angle 371 may allow accessory housing 360 to engage and disengage from mounting baseplate 301 without interfering with the truck mounting bolts installed on a skateboard while mounting baseplate 301 is mounted on the skateboard. The truck mounting bolts may be used to mount mounting baseplate 301 on the skateboard. Mounting angle 371 may be an acute angle measured relative to the plane of surface 303 or the plane of surface 305. In some implementations, mounting angle 371 may be between about 45 degrees and about 89 degrees, or between about 60 degrees and 85 degrees, or between about 70 degrees and about 80 degrees. In some implementations, mounting angle 371 may be about 73 degrees.

In some implementations, mounting element 361 may have a thickness that is thicker than support 311 or thicker than support 313 to provide stability to accessory housing 360 when connected to mounting baseplate 301. As shown in FIG. 3, accessory housing 360 may extend above the plane of mounting baseplate 301 that contacts the skateboard truck mounting plate when mounting system 300 is installed on a skateboard. This may allow accessory housing 360 to fit between the truck hanger and the skateboard deck of the skateboard truck installed on the skateboard to ensure mounting system 300 does not interfere with the standard operation of the skateboard.

Figure 4:
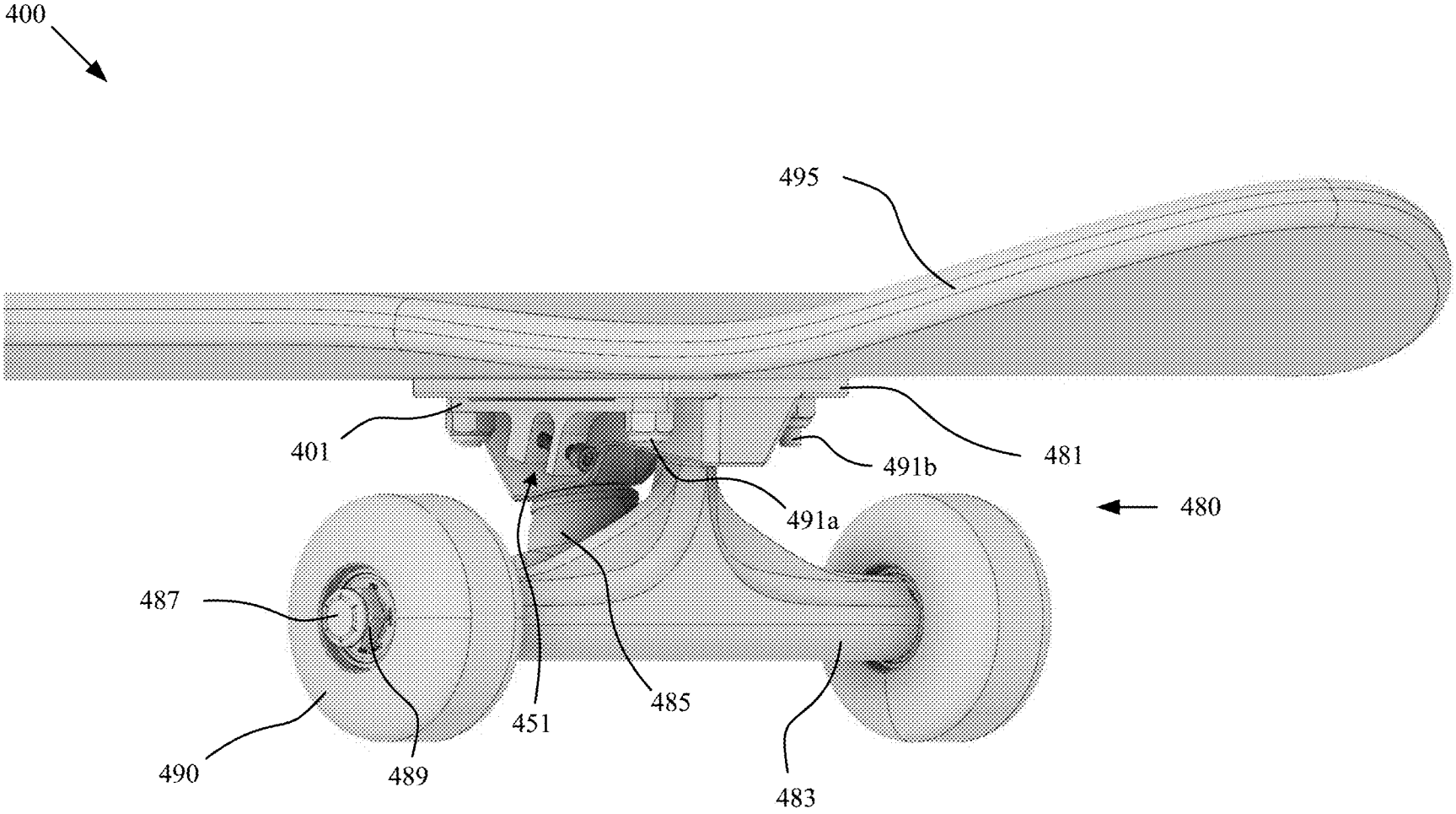
FIG. 4 shows the system for mounting accessories on skateboards of FIG. 1 mounted on a skateboard, according to one implementation of the present disclosure.

FIG. 4 shows a diagram of an exemplary system for mounting accessories on skateboards mounted on a skateboard, according to one implementation of the present disclosure. Diagram 400 shows mounting baseplate 401 mounted with skateboard truck 480 on skateboard deck 495. Skateboard truck 480 includes skateboard truck baseplate 481, skateboard truck hanger 483 which are connected by a skateboard truck kingpin (not shown). The skateboard truck kingpin connects skateboard baseplate 481 to skateboard truck hanger 483 and passes through skateboard bushing 485. Skateboard hanger 483 includes axle 487 which extends through skateboard hanger 483. Skateboard wheel 490 is mounted on axle 487 and held in place by axle nut 489 such that skateboard wheel is affixed to skateboard truck 480 and can freely rotate about axle 487.

In some implementations, mounting baseplate 401 may be mounted on one side of skateboard truck 480 to enable an accessory, such as a camera or a light, to face in the direction of travel of the skateboard when it is ridden by a skater. In another implementation, mounting baseplate 401 may be mounted on the other side of skateboard truck 480 such that an accessory mounted therein will face in the opposite direction of travel when the skateboard is ridden by a skater. Mounting baseplate 401 may be configured to mount on the truck mounting hardware on one side of the longitudinal axis of the skateboard or on the other side.

As shown in FIG. 4, the support elements of mounting baseplate 401 extend from mounting baseplate substantially perpendicular to a mounting plane of skateboard truck baseplate 481. In some implementations, mounting baseplate 401 may not extend beyond the boundary defined by the perimeter of skateboard truck baseplate 481. This configuration helps to maintain the axes of rotation of the skateboard by not substantially changing the moment of inertia of the skateboard about the longitudinal axis or a transverse axis.

In some implementations, mounting baseplate 401 may be installed on skateboard deck 495 such that the mounting angle directs the receiving port towards the middle of the skateboard. Such a configuration may position the receiving port towards the kingpin of the skateboard truck. Accessory housing 460 may be installed into mounting baseplate 401 without interference from the truck mounting hardware and without interference from the skateboard truck hanger.

Figure 5:
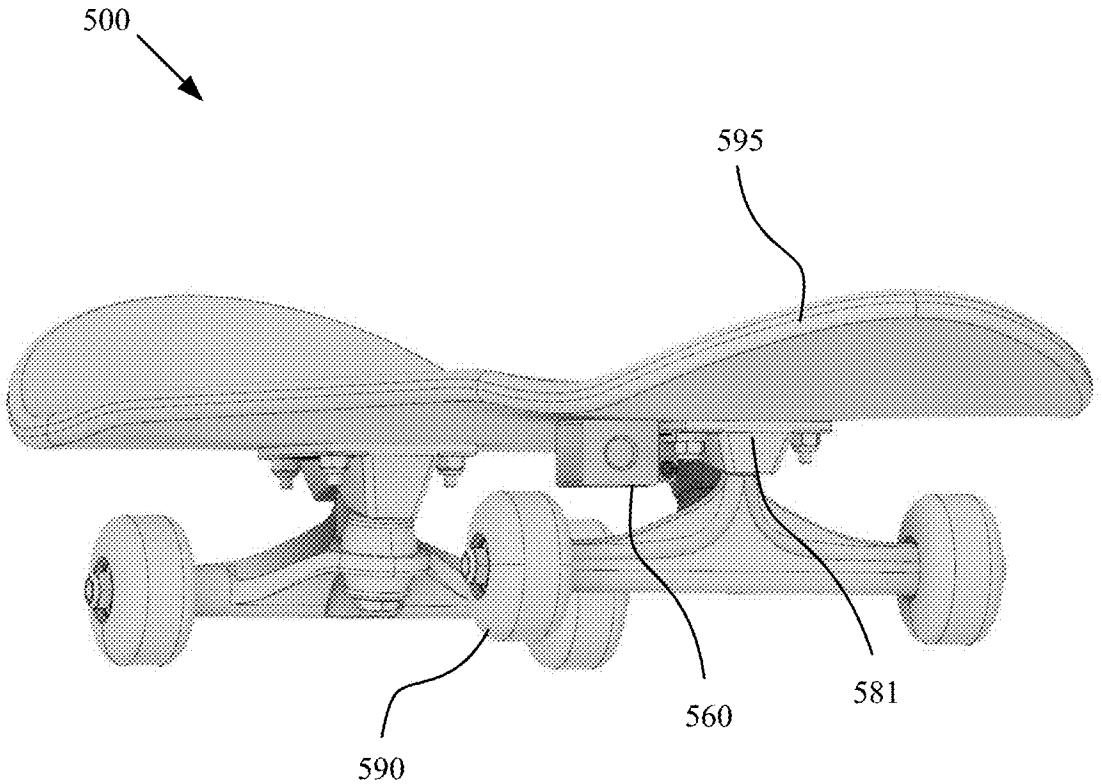
FIG. 5 shows the system for mounting accessories on skateboards of FIG. 2 mounted on a skateboard, according to one implementation of the present disclosure, according to one implementation of the present disclosure.

FIG. 5 shows a diagram of another exemplary system for mounting accessories on skateboards mounted on a skateboard, according to one implementation of the present disclosure. Diagram 500 shows accessory housing 560 mounted on mounting baseplate 501. As shown in FIG. 5, accessory housing 560 extends upward, in the direction towards skateboard deck 595, past the plane of truck baseplate 581 opposite skateboard deck 595. In some implementations, accessory housing 560 may extend upwards, towards skateboard deck 595, and downwards, away from skateboard deck 595. This configuration may assist in keeping accessory housing 560 near the center of gravity of the skateboard. This configuration may assist in keeping accessory housing 560 steady so that footage recorded by a camera housed by accessory housing 560 may be steady footage.

As shown in FIG. 5, accessory housing 560 may be secured in position with an inner side of accessory housing 560 nearest the longitudinal axis of the skateboard next to the outer edge of skateboard truck baseplate 581. In some implementations, accessory housing 560 may be nearly in contact with skateboard truck baseplate 581 or may be in contact with skateboard truck baseplate 581. Contacting skateboard truck baseplate 581 may provide additional stabilization for an accessory housed in accessory housing 560. In some implementations, accessory housing 560 may have an accessory port 551 facing towards a proximate end of skateboard deck 595 or facing towards the middle of skateboard deck 595. The direction that the accessory port faces (e.g., forwards or rearwards) may depend on the direction a user is travelling on the skateboard.

Accessory housing 560 may extend outwards from truck mounting baseplate 581 towards an outer edge of skateboard deck 595. In some implementations, accessory housing 560 may be configured so that an outer, lower corner of accessory housing 560 diagonal from the corner disposed at the intersection of skateboard deck 595 and skateboard truck baseplate 581, is outside the range of motion of skateboard wheel 590 as a user of the skateboard turns while skating. This configuration allows the skater using the skateboard to use the accessory mounting system without interfering with the performance of the skateboard.

From the above description, it is manifest that various techniques can be used for implementing the concepts described in the present application without departing from the scope of those concepts. Moreover, while the concepts have been described with specific reference to certain implementations, a person having ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

What is claimed is:

1. A system for mounting accessories on skateboards including:

a mounting baseplate having a first side and a second side opposite the first side, a first support and a second support extending from the second side of the mounting baseplate, at least two mounting holes in the mounting baseplate from the first side to the second side, the mounting holes being substantially perpendicular to a plane of the second side of the mounting baseplate and spaced apart from each other at a distance equal to a distance of truck mounting bolts for mounting a skateboard truck to a skateboard;

a receiving port having a first end and a second end, wherein the second end is proximate to the mounting baseplate and is a closed end, wherein the receiving port is defined by the first support and the second support, wherein the second support includes a threaded retention element, the receiving port angled at an acute mounting angle; and a securing element extending through the first support and the second support and engaging the threaded retention element.

2. The system for mounting accessories on skateboards of claim 1, further comprising:

an accessory housing including an accessory body and a mounting element extending from the accessory body, the accessory housing connected to the mounting baseplate by the mounting element engaged with the receiving port and secured in place by the securing element, wherein the securing element extends through the first support of the receiving port, through the mounting element, and through the second support of the receiving port, and wherein the receiving port is oriented at the acute mounting angle to allow engagement of the accessory housing without interference from a truck mounting hardware.

3. The system for mounting accessories on skateboards of claim 2, wherein the accessory is one of a camera and a light.

4. The system for mounting accessories on skateboards of claim 3, wherein the camera is one of a still camera and a video camera.

5. The system for mounting accessories on skateboards of claim 1, wherein the acute mounting angle is an acute angle between about thirty degrees and about ninety degrees measured from the plane of the second side of the mounting baseplate.

6. The system for mounting accessories on skateboards of claim 1, wherein the mounting baseplate is formed in the baseplate of the skateboard truck.

7. The system for mounting accessories on skateboards of claim 1, wherein the mounting baseplate is a separate baseplate for installation on the skateboard on a lower side of a skateboard truck baseplate, wherein the lower side of the skateboard truck baseplate is opposite an upper side of the skateboard truck baseplate, the upper side of the skateboard truck baseplate being a side facing a skateboard deck when a complete skateboard is assembled.

8. The system for mounting accessories on skateboards of claim 1, wherein the mounting baseplate is mounted on one of a front truck of the skateboard and a rear truck of the skateboard.

9. The system for mounting accessories on skateboards of claim 1, wherein the mounting baseplate is mounted on one of a left side of the skateboard and a right side of the skateboard.

* * * * *